US005356267A

United States Patent [19]

Fulmer

[11] Patent Number: 5,356,267

[45] Date of Patent: Oct. 18, 1994

[54] PERISTALTIC PUMP WITH REMOVABLE COLLAPSING MEANS AND METHOD OF ASSEMBLY

[75] Inventor: Frederick Fulmer, Santa Cruz, Calif.

[73] Assignee: Beta Technology, Inc., Santa Cruz, Calif.

[21] Appl. No.: 91,982

[22] Filed: Jul. 15, 1993

Related U.S. Application Data

[63] Continuation-in-part of Ser. No. 967,173, Oct. 27, 1992, abandoned.

[51] Int. Cl.[5] ..... F04B 43/08

[52] U.S. Cl. ..... 417/53; 417/360; 417/477.1; 29/428

[58] Field of Search ..... 417/474–477, 417/360, 28, 53; 604/153; 29/428

[56] References Cited

U.S. PATENT DOCUMENTS

| | | | |
|---|---|---|---|
| 3,103,178 | 9/1963 | Thompson | 417/477 |
| 4,138,205 | 2/1979 | Wallach | 417/477 |
| 4,211,519 | 7/1980 | Hogan | 417/477 |
| 4,315,718 | 2/1982 | Hogan | 417/477 |
| 4,392,794 | 7/1983 | Foxcroft | 417/477 |
| 4,519,754 | 5/1985 | Minick | 417/477 |
| 4,545,744 | 10/1985 | Weber et al. | 417/477 |
| 5,049,048 | 9/1991 | Streicher | 417/477 |
| 5,052,900 | 10/1991 | Austin | 417/477 |
| 5,110,270 | 5/1992 | Morrick | 417/477 |

*Primary Examiner*—Louis J. Casaregola
*Assistant Examiner*—Peter Korytnyk
*Attorney, Agent, or Firm*—Flehr, Hohbach, Test, Albritton & Herbert

[57] ABSTRACT

A peristaltic pump with a replaceable pump head cartridge is disclosed. The removable cartridge includes a length of flexible tubing and a collapsing device, such as a rotor assembly, for successively collapsing the inner wall of consecutive portions of the tubing to propel fluid through the tubing. A cartridge housing at least partially encloses the tubing and the collapsing device. The collapsing device is supported on a cylindrical pin integral with the housing. The housing is mountable to and removable from the motor with the tubing substantially contained within the housing. The method of assembling the peristaltic pump includes the steps of forming a housing and positioning a flexible tubing within the housing. A rotor assembly is inserted into the interior of the housing. The housing is mounted to a motor which is provided for powering operation of the rotor assembly, and the ends of the tubing are connected to a supply fluid line and a delivery fluid line respectively.

23 Claims, 3 Drawing Sheets

PERISTALTIC PUMP WITH REMOVABLE COLLAPSING MEANS AND METHOD OF ASSEMBLY

CROSS-REFERENCE TO RELATED APPLICATIONS

This application is a continuation-in-part of co-pending U.S. application, Ser. No. 07/967,173, filed Oct. 27, 1992, now abandoned.

BACKGROUND OF THE INVENTION

The present invention relates in general to pumps used for metering fluids. More particularly, the present invention relates to peristaltic pumps.

Many chemical dispensing systems utilize peristaltic pumps to supply chemicals in measured amounts. With industrial dish and clothes washers for example, peristaltic pumps meter the caustic and viscous chemicals used during the various wash and rinse cycles. The pumps typically include a length of flexible tubing and a rotatable spinner assembly having diametrically opposed rollers. The rollers press the inner walls of the tubing together at two points. As the spinner assembly is rotated, the rollers are moved along a curved section of tubing, forcing a measured amount of liquid through the tube. The required amount of a chemical may be delivered simply by operating the pump for a specific period of time.

Proper functioning of the peristaltic pump is dependent upon the ability of the spinner assembly to collapse the walls of the flexible tubing. The chemicals delivered with the chemical dispensing system often rapidly corrode the tubing. The continuous compression by the rollers wears down the flexible tubing, resulting in chemical leakage. Moreover, over time the tubing will harden, preventing the rollers from effectively squeezing the tubing wall. The flexible tubing must therefore be periodically replaced to ensure efficient and accurate operation of the peristaltic pump.

With available peristaltic pumps, replacement of the tubing is a complex, manually intensive and time consuming process which generally must be completed by a trained individual. The cover of the pump head must be removed, and the tubing disconnected from the input and output hoses and withdrawn from between the spinner assembly and the main body of the pump head. As the tubing is extracted from the pump head, any liquid remaining within the tubing is released. Depending upon the nature of the chemical, the spillage of excess liquid may be harmful and destructive in addition to creating a mess, potentially injuring the service individual and damaging nearby equipment. Since the maintenance is usually performed with the main body of the pump head installed for use, the required service often must be completed in awkward and inconvenient working conditions.

The present invention provides a peristaltic pump including a pump head designed as a removable cartridge. Instead of disassembling the pump head on site to remove the used flexible tubing, the entire pump head cartridge may be conveniently and efficiently replaced.

The spinner assembly must be freely rotatable and the rollers must completely collapse the tubing walls for efficient operation of the peristaltic pump. Many available peristaltic pumps are therefore designed having strict tolerance requirements, substantially increasing the cost of manufacture. Alternatively, various pumps include spring-loaded rollers for pressing the inner tube walls together while guaranteeing unrestricted rotation of the spinner assembly. The use of spring-loaded rollers increases the tolerances with which the peristaltic pump is designed. However, the spring-loaded rollers are more complex and higher in cost than other types of rollers.

The present invention provides a pump head cartridge which is not permanently mounted to the motor, but is instead secured so as to provide easy removal of the pump head from the motor. The cartridge housing is preferably formed of a material having some flexibility. With the flexible cartridge housing and the slight movement of the pump head during operation, a productive peristaltic pump may be manufactured under less restrictive tolerances.

SUMMARY OF THE INVENTION

In summary, the present invention provides a peristaltic pump with a pump head cartridge which is removable for convenient replacement. The removable cartridge assembly includes a housing with an integral cylindrical pin, a rotor assembly mounted to the pin and a length of flexible tubing through which fluid may pass. The rotor assembly successively compresses consecutive portions of the tubing, collapsing the inner tubing wall to propel fluid through the pump. The cartridge housing encloses the flexible tubing and the rotor assembly, and is mounted to and removed from the motor with the tubing retained inside. The rotor assembly includes a hub which is formed to interlock with the drive shaft of the motor. Instead of solely removing the used tubing, the rotor is separated from the motor drive shaft and removed with the cartridge assembly and the entire cartridge is replaced.

The present invention further provides a method for assembling a peristaltic pump which includes the steps of forming a housing and positioning a length of flexible tubing within the housing. A rotor assembly for successively collapsing the tubing inner wall is substantially inserted into the interior of the housing and rotatably mounted to a fixed cylindrical pin. As consecutive sections of the inner wall are collapsed, fluid is propelled through the tubing. The housing is mounted to a motor which is provided for rotating the rotor assembly about the fixed pin. One of the opposed ends of the length of tubing is coupled to a fluid supply line, while the other is connected to a fluid delivery line.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
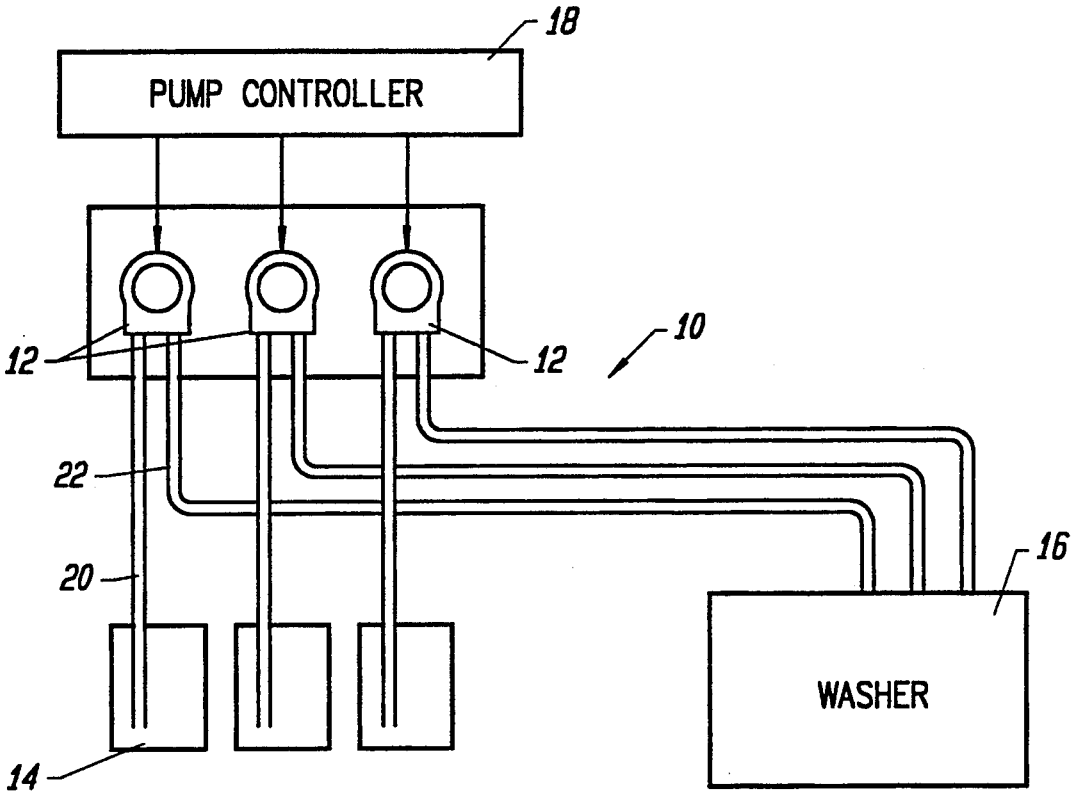
FIG. 1 is a block diagram of a simplified chemical delivery system incorporating a peristaltic pump in accordance with the present invention.
Figure 2:
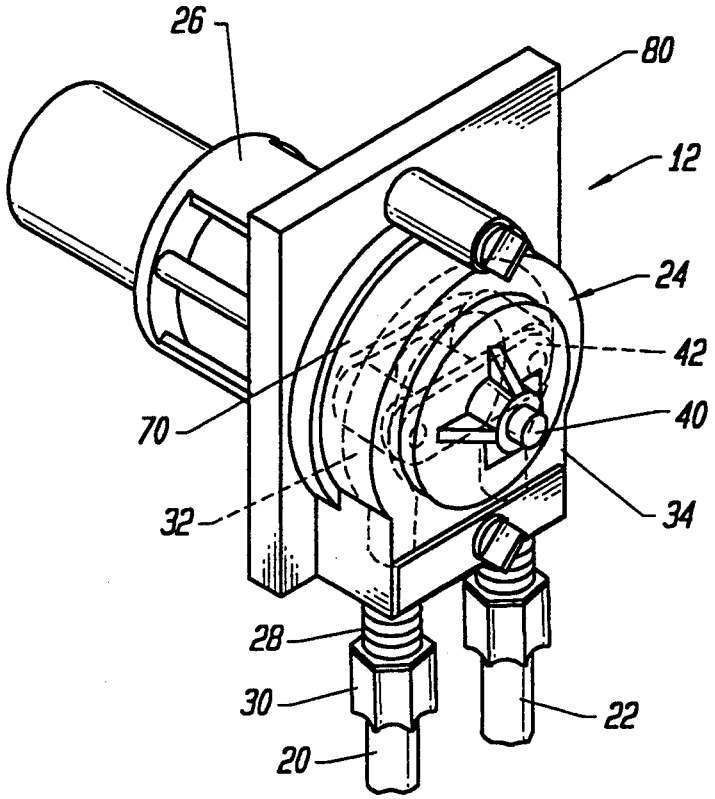
FIG. 2 is a front perspective view of a peristaltic pump in accordance with the present invention.

Reference will now be made in detail to the preferred embodiment of the invention, which is illustrated in the accompanying figures. Turning now to the drawings, wherein like components are designated by like reference numerals throughout the various figures, attention is directed to FIG. 1.

FIG. 1 generally shows a liquid chemical delivery system 10 incorporating a number of peristaltic pumps 12 in accordance with the present invention. When any one of the pumps is activated, the liquid delivery system 10 delivers chemicals from a corresponding one of the source containers 14 to a washer, generally indicated 16. As the liquid is pumped through the system, a pump control 18 operates the activated peristaltic pump to meter the fluid. The chemicals pass through a fluid supply line 20 to the pump 12, which then transports the fluid into a fluid delivery line 22. The pump control directs the operation of each respective pump as required during the wash cycle. The peristaltic pump will continue to operate, transporting liquid into the delivery line 22, until the desired amount of fluid has been delivered to the washer. Peristaltic pumps 12 thereby ensure that the required volume of each chemical is supplied during the wash cycle.

A peristaltic pump 12 of the present invention will now be described in greater detail in relation to FIGS. 2–5. The peristaltic pump includes a removable pump head or cartridge assembly 24 which is mounted to a motor 26. The fluid supply line 20 and fluid delivery line 22 are coupled to a pair of connecting members or tube fittings 28 which extend from within the cartridge 24. In the present embodiment, the exterior of tube fittings 28 is threaded and the supply and delivery lines are provided with a tube coupler 30. The interior of tube coupler 30 is threaded complementary to tube fittings 28. The fluid lines are connected to the peristaltic pump simply by screwing the tube couplers onto the connecting member. The cooperating tube couplers 30 and connecting member 28 provide a convenient and efficient method of securing the fluid lines to the pump 12. However, other known means for coupling together tubing may be substituted for the couplers 30 and the tube fittings shown in the illustrated embodiment.

Figure 3:
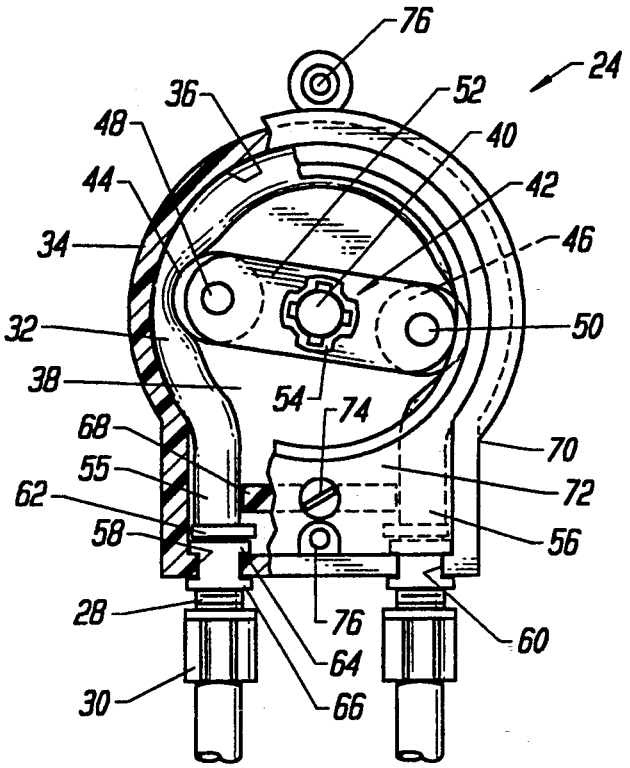
FIG. 3 is a rear view of the pump head cartridge of the peristaltic pump of FIG. 2, shown with the housing partially broken away.
Figure 5:
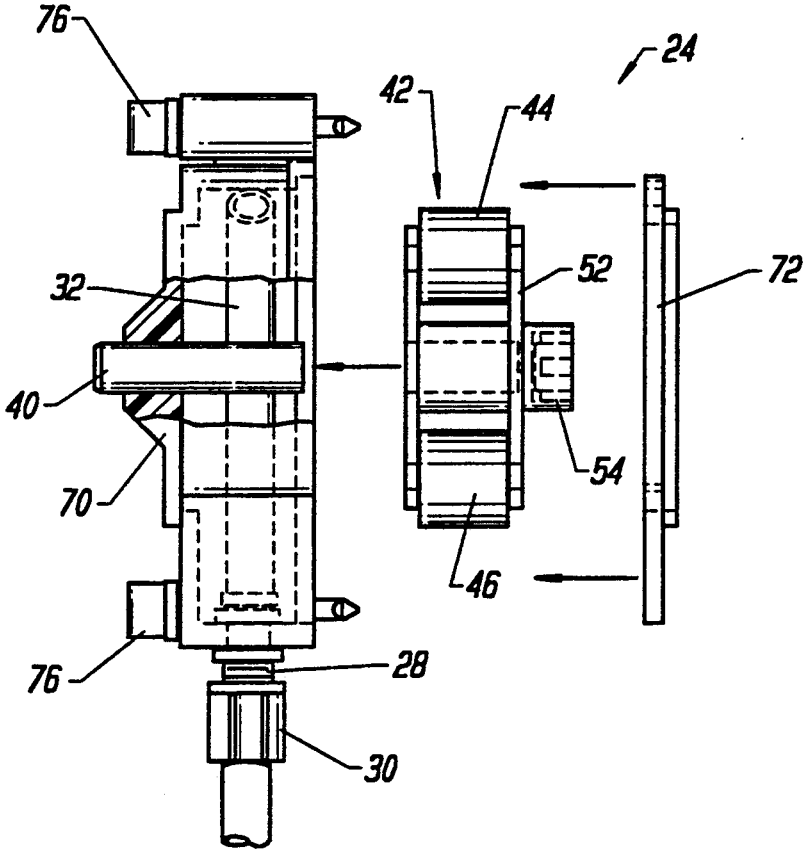
FIG. 5 is an exploded view of the pump head cartridge of the peristaltic pump of FIG. 2.

In the preferred embodiment, the main pump head components are contained within the removable cartridge. Turning particularly to FIGS. 3 and 5, cartridge assembly 24 includes a length of flexible tubing 32 positioned within a housing 34. The housing has an interior peripheral wall 36 which defines a central cavity 38. As is shown in FIG. 5, the housing 34 includes two members, a cover 70 and a back plate 72 coupled to the cover by a screw 74. A cylindrical pin or shaft 40 is mounted to the cover 70 of the housing, projecting into cavity 38. The pin 40 is fixedly secured to the housing cover 70, forming an integral part of the housing 36. The cylindrical pin 40 may be press fit into an aperture formed in the cover 70 of the housing. Alternatively, the pin 40 may be mounted to the housing 34 using other securement means such as adhesive and the like.

A rotor assembly 42 mounted to the cylindrical pin 40 compresses the tubing against the housing wall with rollers 44 and 46. By squeezing the tubing, the inner wall is collapsed (FIG. 4), capturing the fluid between the opposed rollers. During operation of the pump, the rotor assembly is rotated about the fixed pin 40 relative to the tubing 32. One advantage of the fixed pin 40 is that the need for bearings for supporting a rotating pin is avoided. Thus, the cartridge assembly is easier and less expensive to manufacture. The rollers 44 and 46 successively compress consecutive sections of tubing as the rotor assembly is rotated, propelling forward any fluid in front of the rollers. A measurable amount of fluid is contained within the tubing between the opposed rollers. With each rotation of the rotor assembly 42, a known volume of fluid is transported through the pump. By driving the rotor assembly through a specified number of rotations, the required amount of fluid is transported to the delivery fluid line 22.

In the present embodiment, rotor assembly 42 includes a pair of spaced apart roller shafts 48 and 50 mounted to a roller carriage 52. Rollers 44 and 46 are carried by the roller shafts. As the rotor assembly is rotated, the rollers are allowed to rotate about shafts 48 and 50. A rotor hub 54 projects from the roller carriage 52 and, as is discussed further in relation to FIG. 4, is formed for interlocking with the drive shaft of the motor 26.

In the preferred form, housing 34 of the pump head assembly 24 retains the tubing in a generally U-shaped configuration. The opposed ends 55 and 56 of tubing 32 are positioned within the housing, with tube fittings 28 extending through slots 58 and 60. A clasp 62 secures each of the tube ends 55 and 56 about the tube fittings, which are formed with a pair of spaced apart flanges 64 and 66. The flanges grip the edges of the slots in the housing, thereby securing the tubing in place. A spacer 68 is formed in the housing to maintain the separation of the opposed ends and facilitate installation of the tubing. The tubing 32 is thereby securely retained within the cartridge housing.

In the present embodiment, the cartridge assembly further includes retaining means for flexibly securing the assembly 24 to the motor 26. One such retaining means is provided by a pair of quarter-turn pins 76. When the cartridge 24 is installed (FIGS. 2 and 4), the pins 76 are pressed into apertures formed in the front face 80 of the motor. Instead of being firmly bolted in place, the pins 76 loosely secure the cartridge assembly to the motor, allowing the cartridge assembly to "float." The pump head is thereby allowed to move or vibrate relative to the motor during operation of the rotor assembly 42.

Figure 4:
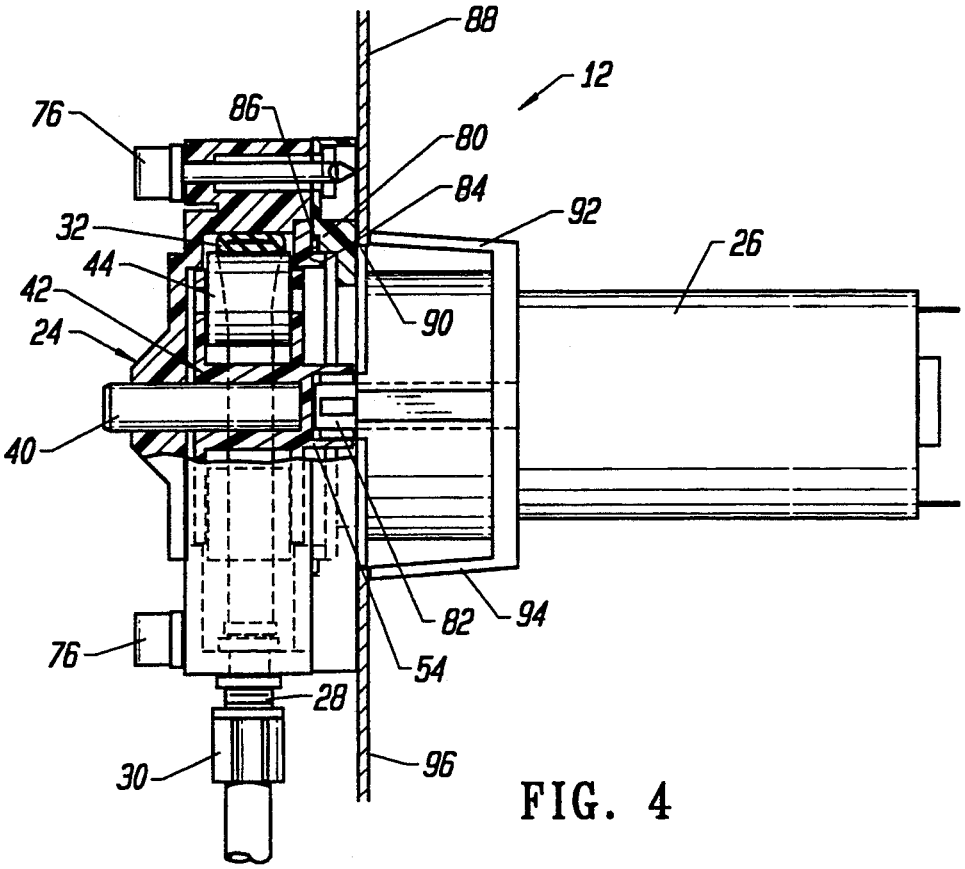
FIG. 4 is a side elevational view of the peristaltic pump of FIG. 2 installed in a pump casing, shown partly in cross section.

As is shown particularly in FIG. 4, motor 26 is formed with a drive shaft 82 which is shaped for insertion into the rotor hub 54. The drive shaft 82 interlocks with the hub 54 when the pump is installed to rotate the rotor assembly 42 about the fixed pin 40 during operation of the motor 26. The pump head assembly may be conveniently replaced without requiring extensive adjustment of the pump. In the present embodiment, the motor includes a spline-shaped drive shaft. However, drive shafts may be provided with other configurations.

Since the cartridge assembly is loosely secured to the motor, the assembly 24 may have a tendency to rotate slightly relative to drive shaft 82 during operation. In the preferred form of the present invention, peristaltic pump 12 further includes coupling means for interconnecting housing 34 and motor 26. One such coupling means is provided by at least one notch 84 formed in motor face 80 and at least one complementary formed tab or projection 86 (FIG. 4). In the present embodiment, four evenly spaced notches and projections are provided on the motor face and housing respectively.

When the pump head cartridge is installed, the projections on the housing are seated within the notches. The interengagement between the notches and tabs effectively maintains the positioning of the cartridge assembly during operation. Moreover, the tabs, drive shaft and complementary housing guide the cartridge during installation.

In the preferred form the housing is formed of a flexible material, such as polyurethane. The flexibility of the housing and the engagement between the rotor 42 and the fixed pin 40 ensure the tubing will be fully compressed without interfering with rotation of the rotor assembly. Manufacturing variations in the rotor assembly will thereby be accommodated. As such, the tolerances with which the components are manufactured may be relaxed, substantially reducing the cost of manufacture.

The present invention provides a pump head cartridge assembly which may be conveniently and efficiently removed and replaced. To remove the cartridge 24, the supply and delivery fluid lines 20 and 22 are disengaged from tube fittings 28. The quarter turn pins 70 are turned, releasing the housing from motor face 80. The pump head assembly 24 is removed by simply pulling the cartridge away from the motor. A replacement cartridge may be installed by reversing the steps for removal. The process may be completed by any individual, with the pump head assembly being serviced by a trained individual, without significantly disrupting the operation of the liquid delivery system.

With the present embodiment, the pump 12 is contained within pump casing 88. The motor 26 is inserted through opening 90, with front face 80 held against the exterior of the casing 88. A pair of cantilevered flanges 92 and 94 abut the inner wall 96 of the pump casing, holding the motor in place. The flanges 92 and 94 are provided with a limited degree of flexibility for removal of motor 26. Thus, if the peristaltic pump 12 fails to function properly, motor 26 may be easily removed by pressing flanges 92 and 94 toward the main body of the motor. The motor may then be pulled through the opening and replaced.

Each cartridge assembly 24 is provided as a compact unit. Upon removal, the used cartridge may be returned to a service facility and disassembled. Alternatively, the maintenance may be performed on site. The tubing may be discarded and replaced. The interior of the housing may be cleaned, removing any chemical leakage. The rotor assembly may similarly be inspected and cleaned, and if necessary, replaced. By installing a replacement cartridge, operation of the liquid delivery system is not disrupted.

Once the cartridge 24 has been separated from the motor for maintenance of the pump 12, the housing may be opened by removing the back plate. The rotor assembly 42 is pulled from the fixed pin 40 and removed from the interior cavity 38 of the housing. With the rotor assembly withdrawn from the cavity, the tubing 32 may be easily replaced. The cartridge 24 is reassembled by positioning the rotor assembly 42 on the fixed pin 40 and replacing the back plate. The fixed pin 40 aligns the rotor assembly 42 with the a central axis of the interior cavity 38, positioning the rollers for applying a substantially uniform pressure on the tubing as the rotor assembly is rotated. The fixed pin also guarantees concentric alignment between the rotational axis of the rotor assembly and the drive shaft 82 when the replaceable cartridge 24 is installed on motor 26. Mounting the rotor assembly 42 on the cylindrical pin 40 substantially prevents misalignment of the rollers 44 and 46 which may reduce the accuracy and efficiency of the pump.

As is apparent from the foregoing discussion, the present embodiment provides a peristaltic pump which is easy to service and maintain. Used tubing may be regularly replaced by removing the pump head as a unit prior to disassembling the housing. A replacement cartridge assembly may be quickly snapped into place without disrupting operation of the liquid delivery system. The motor may similarly be effortlessly removed from the pump casing and replaced.

What is claimed is:

1. A removable cartridge assembly for a peristaltic pump, said pump having a motor providing power thereto, said cartridge assembly comprising:

(a) a length of flexible tubing having an inner wall defining a passageway for fluid within said tubing;

(b) collapsing means for successively collapsing said inner wall of consecutive portions of said tubing to thereby propel fluid within said passageway through said tubing; and (c) a cartridge housing at least partially enclosing said flexible tubing and said collapsing means, which housing is mountable to and removable from said motor with said tubing substantially contained within said housing, said housing having a stationary cylindrical pin integral with said housing, said pin supporting said collapsing means for successively collapsing said tubing.

2. The removable cartridge assembly of claim 1 wherein, said flexible tubing has first and second ends positioned within said housing, each of said ends having a connecting member provided thereon, each said connecting member extending through and projecting from said housing for receiving one of a supply fluid line and a delivery fluid line.

3. The removable cartridge assembly of claim 1 wherein, said collapsing means includes a rotor rotatably mounted on said pin, said rotor having at least one roller for collapsing said inner wall of said consecutive portions of said tubing.

4. The removable cartridge assembly of claim 1, further comprising drive means for interconnecting said collapsing means to said motor for powering operation of said collapsing means.

5. The removable cartridge assembly of claim 1 wherein, said housing is formed of a flexible material.

6. The removable cartridge assembly of claim 1 wherein, said housing includes first and second housing members and securing means for securing said housing members together, said first and second housing members being separable for removal of said tubing from said housing.

7. A peristaltic pump comprising:

(a) a length of tubing having an inner wall defining a passageway for fluid;

(b) rotary means for successively squeezing said tubing substantially along said length of tubing upon rotation of said rotary means, said rotary means thereby transporting fluid through said tubing;

(c) a motor for powering the rotation of said rotary means;

(d) a housing at least partially encasing said length of tubing and said rotary means, said housing being mountable to and removable from said motor with said length of tubing held within said housing;

(e) a cylindrical pin fixedly mounted to said housing, said pin being stationary relative to said housing, said pin supporting said rotary means within said housing for rotation of said rotary means about said pin relative to said tubing; and (f) retaining means for flexibly securing said housing to said motor, said retaining means providing for vibrational movement of said housing relation to said motor during operation of said rotary means.

8. The peristaltic pump of claim 7, further comprising drive means connecting said motor to said rotary means for operation of said rotary means to successively collapse said inner wall along said length of tubing.

9. The peristaltic pump of claim 7, further comprising coupling means for interconnecting said housing and said motor to prevent rotation of said housing relative to said motor during operation of said rotary means.

10. The peristaltic pump of claim 9 wherein, said coupling means includes at least one notch formed in one of said housing and said motor and at least one projection shaped to engage said notch provided on the other of said housing and said motor.

11. The peristaltic pump of claim 7, further comprising a pump casing for said pump, said casing having at least one aperture formed for receiving said motor, and said motor includes installing means for releasably installing said pump in said casing with said motor extending through said aperture into said casing.

12. A removable pump head assembly for a peristaltic pump having a motor which provides power to said pump, said pump head assembly comprising:

(a) a flexible tubing having an inner wall defining a passageway for fluid through said tubing (b) a housing substantially surrounding said tubing, said housing having an interior peripheral wall at least partially defining a cavity within said housing, said tubing being positioned adjacent said peripheral wall, said housing being mountable to and removable from said motor with said tubing intact;

(c) a cylindrical pin integral with said housing and projecting into said cavity, said pin being stationary relative to said housing;

(d) a rotor carried by said pin and having at least one roller member for pressing said tubing against said peripheral wall to collapse said inner wall to thereby propel fluid through said tubing, which rotor is rotatable about said pin relative to said tubing for successively collapsing consecutive sections of said inner wall; and (e) drive means for connecting said motor to said rotor to power rotation of said rotor about said pin relative to said tubing.

13. The removable pump head assembly of claim 12 wherein, said drive means includes a drive shaft projecting from said motor and a rotor hub carried by said rotor, said drive shaft and said rotor hub being cooperatively formed for interengagement when said housing is mounted to said motor.

14. The removable pump head assembly of claim 13 wherein, one of said drive shaft and said rotor hub is formed as a spline, and the other of said drive shaft and said rotor hub is configured for interlocking with said spline.

15. The removable pump head assembly of claim 12, further comprising retaining means for securing said housing to said motor, which retaining means is flexible to provide for vibration of said housing relative to said motor during operation of said rotary means.

16. The removable pump head assembly of claim 12 wherein, said tubing has opposed ends positioned within said housing, each of said ends having a connecting member provided thereon, each said connecting member extending through and projecting from said housing for receiving one of a supply fluid line and a delivery fluid line.

17. A method for assembling a peristaltic pump comprising the step of:

(a) forming a housing having an interior peripheral wall partially defining a cavity within said housing;

(b) fixedly mounting a cylindrical pin to said housing, said pin being stationary relative to said housing and projecting into said cavity;

(c) positioning a length of flexible tubing within said cavity of said housing, said tubing having an inner wall and first and second ends;

(d) substantially inserting a rotor assembly into said cavity and rotatably mounting said rotor assembly on said pin, said rotor assembly having at least one roller positioned for successively collapsing said inner wall of consecutive portions of said tubing to thereby propel fluid through said tubing;

(e) providing a motor for rotating said rotor assembly about said pin relative to said tubing;

(f) mounting said housing to said motor; and (g) connecting each of said ends to one of a supply fluid line and a delivery fluid line.

18. The method of claim 17 wherein, said housing is formed with first and second housing members, and further comprising the step of securing said housing members together after said step of positioning a length of flexible tubing within said cavity.

19. The method of claim 17, further comprising the step of coupling a connecting member to each of said ends, and said connecting step includes connecting each said connecting member to one of said supply fluid line and said delivery fluid line.

20. The method of claim 17 wherein, said motor includes a drive shaft, said rotor includes a rotor hub configured for interlocking with said drive shaft, and said step of mounting said housing to said motor includes interconnecting said drive shaft and said rotor hub.

21. A method for operating and servicing peristaltic pumps comprising the steps of:

(a) installing pump motors at a plurality of sites;

(b) forming removable cartridge assemblies for use with said pump motors; each removable cartridge assembly including a length of flexible tubing having an inner wall defining a passageway for fluid within said tubing and a cartridge housing at least partially enclosing said flexible tubing, which housing is mountable to and removable from any one of said pumps motors with said tubing substantially contained within said housing, said housing having a stationary cylindrical pin integral with said housing and supporting a rotary assembly for rotation about said pin relative to said tubing; said flexible tubing having first and second ends with respective first and second connecting members provided thereon;

(c) mounting on each pump motor one of said removable cartridge assemblies so as to form a peristaltic pump, and coupling respective liquid chemical supply and delivery tubes to said one cartridge's respective connecting members;

(d) running each of said peristaltic pumps so as to pump liquid chemicals into said delivery tubes;

(e) delivering an additional one of said removable cartridge assemblies to the vicinity of each said pump motors;

(f) after running each respective peristaltic pump for a period of time, disconnecting said respective liquid chemical supply and delivery tubes from said respective peristaltic pump's removable cartridge assembly, removing said removable cartridge assembly from said respective pump motor, mounting on said respective pump motor the additional one of said removable cartridge assemblies that was delivered to the vicinity of said respective pump motor, coupling said respective liquid chemical supply and delivery tubes to said additional removable cartridge's respective connecting members; and (g) repeating steps (d) through (f).

22. The method of claim 21, further including:

after removing each respective removable cartridge assembly from a respective pump motor, replacing the flexible tubing in said respective removable cartridge assembly.

23. The method of claim 21, further including:

after removing each respective removable cartridge assembly from a respective pump motor, replacing the flexible tubing in said respective removable cartridge assembly with new flexible tubing, and then delivering said respective removable cartridge assembly with the new tubing to the vicinity of one of said pump motors.

* * * * *